United States Patent [19]

Huang

[11] 4,266,083

[45] May 5, 1981

[54] BIOMASS LIQUEFACTION PROCESS

[75] Inventor: Max W. Huang, Birmingham, Ala.

[73] Assignee: The Rust Engineering Company, Birmingham, Ala.

[21] Appl. No.: 46,907

[22] Filed: Jun. 8, 1979

[51] Int. Cl.[3] ..... C10G 1/06

[52] U.S. Cl. ..... 585/240; 201/21; 208/10

[58] Field of Search ..... 208/10; 201/2.5; 585/240

[56] References Cited

U.S. PATENT DOCUMENTS

| | | | |
|---|---|---|---|
| 2,160,341 | 5/1939 | Reichert | 202/16 |
| 3,244,615 | 4/1966 | Huntington | 208/97 |
| 3,642,607 | 2/1972 | Seitzer | 208/8 |
| 3,733,255 | 5/1973 | Appell et al. | 201/25 |
| 3,796,650 | 3/1974 | Urban | 208/10 |
| 3,841,991 | 10/1974 | Cohen et al. | 208/8 |
| 3,846,275 | 11/1974 | Urban | 208/10 |
| 3,864,096 | 2/1975 | Urban | 44/50 |
| 3,864,097 | 2/1975 | Urban | 44/50 |
| 3,920,536 | 11/1975 | Seitzer et al. | 208/8 |
| 3,923,634 | 12/1975 | Silvestri | 208/10 |
| 3,926,775 | 12/1975 | Schroeder | 208/10 |
| 4,038,172 | 7/1977 | Ueda et al. | 208/10 |
| 4,089,773 | 5/1978 | Espenscheid | 208/8 |
| 4,102,749 | 7/1978 | Hess et al. | 201/2.5 |
| 4,157,246 | 6/1979 | Eakman et al. | 48/197 R |

OTHER PUBLICATIONS

Chemical and Engineering News May 29, 1972, "From Agricultural Wastes to Feed or Fuel", pp. 14–15.

Bureau of Mines Technical Progress Report 25 Solid Waste Program, Conversion of Urban Refuge to Oil, May 1975, Appell et al.

*Primary Examiner*—Delbert E. Gantz

*Assistant Examiner*—William G. Wright

*Attorney, Agent, or Firm*—Schuyler, Banner, Birch, McKie & Beckett

[57] ABSTRACT

This invention is directed to a process for the conversion of solid cellulosic biomass materials or lignite to oil. A solids-oil slurry is contacted in a reactor with carbon monoxide and water vapor in the presence of an alkali metal and alkaline earth metal carbonate, bicarbonate or formate catalyst at a temperature of from about 250° C. and to about 450° C. at a pressure of from about 2000 psig to about 5000 psig. The gases from the reactor and oil hydrocarbon fuel, preferably a recycled heavy fraction of product oil containing spent catalyst, are burned at a pressure above the reactor pressure with oxygen to provide a carbon monoxide-water vapor gas having a temperature of from about 1100°C. to about 1600° C. Said gas is introduced under the surface of the oil slurry in the reactor to provide heat, carbon monoxide, water vapor, and, desirably, regenerated catalyst to said reactor.

10 Claims, 1 Drawing Figure

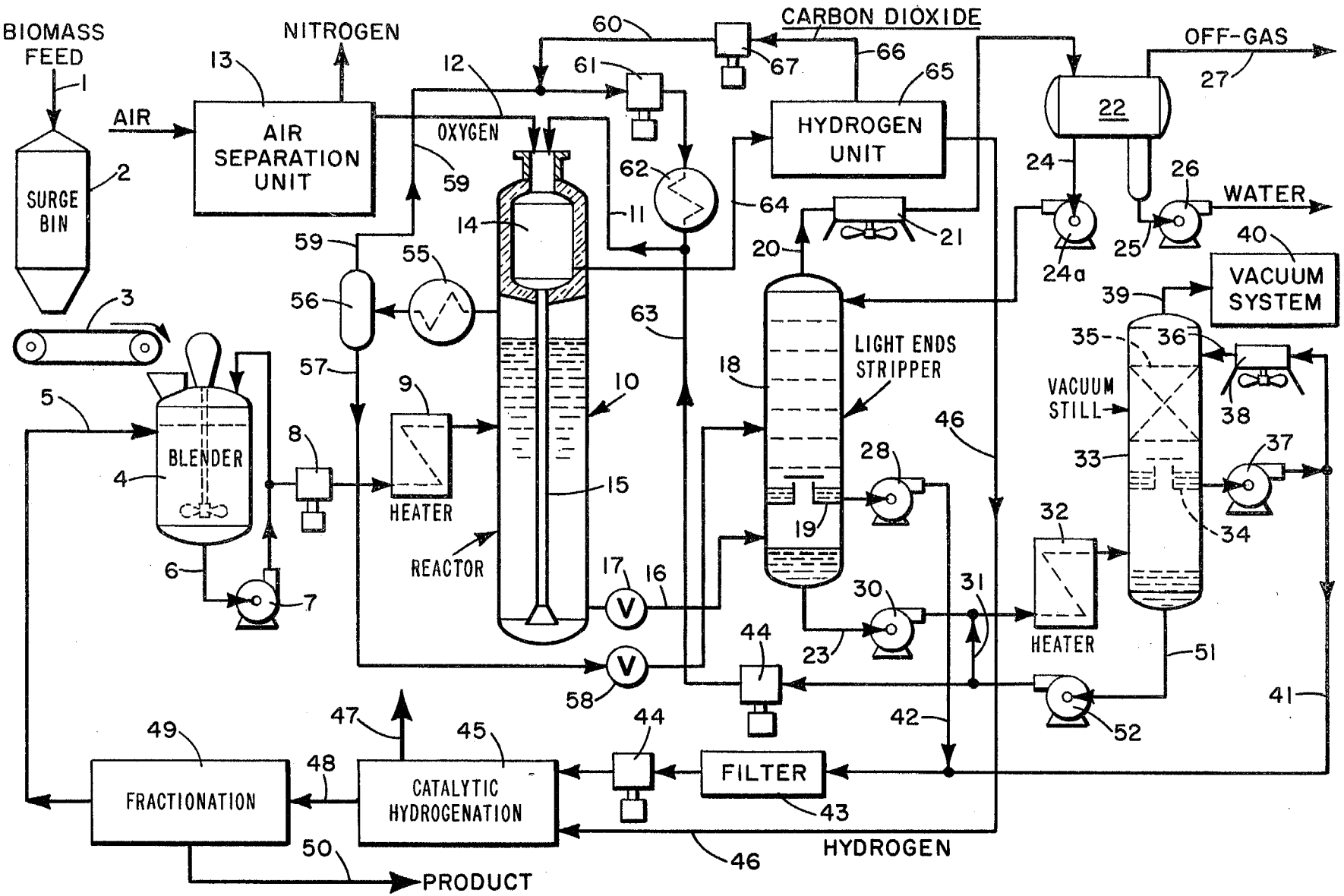
OFF-GAS
WATER
VACUUM SYSTEM
VACUUM STILL
HEATER
LIGHT ENDS STRIPPER
HYDROGEN UNIT
CARBON DIOXIDE
HYDROGEN
FILTER
OXYGEN
NITROGEN
AIR SEPARATION UNIT
AIR
REACTOR
HEATER
BLENDER
CATALYTIC HYDROGENATION
PRODUCT
FRACTIONATION
BIOMASS FEED
SURGE BIN

BIOMASS LIQUEFACTION PROCESS

BACKGROUND OF INVENTION

This invention relates to a process for the continuous liquefaction of solid cellulosic biomass materials or lignite.

Alkaline materials such as sodium carbonate are known to catalyze the conversion of cellulosic materials into oil in the presence of carbon monoxide and water. This was discovered by Fischer and Schrader in 1921 and later confirmed by Appell, et al. in a series of laboratory and bench-scale experiments carried out at the Pittsburgh Energy Research Center of the Bureau of Mines, U.S. Department of the Interior, during the late 1960's to the early 1970's.

After the technical and economic feasibility was established, a pilot plant capable of treating up to 3 tons/-day of wood chips was designed and constructed under the sponsorship of the U.S. Government. The process employed in the U.S. pilot plant comprises the following steps:

(1) An optional pretreatment of wood chips with water at 500° F. (260° C.) and 750 psig;

(2) Drying and grinding of untreated or treated wood chips to less than about 4% by weight moisture and about −50 mesh average particle size;

(3) Blending the wood particles with recycle product oil to form from about 30 to about 50% by weight of a wood in oil slurry at about 200° F. (93° C.);

(4) Pumping the wood-oil slurry to develop up to 4,100 psig pressure;

(5) Addition of carbon monoxide and aqueous sodium carbonate solution to the high pressure wood-oil slurry;

(6) Heating the wood-oil-carbon monoxide-sodium carbonate-water mixture to up to about 750° F. (400° C.) temperature in a scraper blade preheater;

(7) Conversion of wood to oil in a stirred tank reactor in which the wood-oil slurry is maintained at about 750° F. (400° C.);

(8) Cooling the high pressure crude reaction product to less than 400° F. (204° C.) temperature;

(9) Flashing the cooled, crude reaction product to a near atmospheric pressure to separate the dissolved gases;

(10) Separation of water and solids from the crude oil product by a centrifuge; and

(11) Recycling a portion of the product oil to prepare further wood-oil slurry.

The operation of the pilot plant during early 1976 to mid 1978 revealed certain operational and/or mechanical deficiencies. The product oil tended to polymerize, which resulted in difficulty of recycling the product oil as feed carrier oil. The scraper blade feed slurry heater and the agitated reactor experienced frequent failures. Difficulty was also encountered in attempts to separate water and solids from the crude oil product.

It is an object of this invention to provide a novel, improved process for the continuous conversion of solid biomass material into oil by treatment with carbon monoxide and water at elevated temperature and pressure in the presence of a catalyst and recycled product oil.

Another object of this invention is to provide a novel process for generating and supplying carbon monoxide for the reaction.

A further object of this invention is to provide a thermally efficient process for heating the reaction mixture to a desired temperature for carrying out the reaction.

Yet another object of this invention is to provide an improved process for the separation of water and solids from the crude product oil.

Still another object of this invention is to provide a novel, inexpensive process for recovering the catalyst from the crude product oil and recycling the catalyst for reuse in the biomass liquefaction.

DETAILED DESCRIPTION OF THE INVENTION

This invention is directed to a process for the conversion of solid materials selected from the group consisting of cellulosic biomass materials and lignite to oil wherein a solids-oil slurry is contacted in a reactor with carbon monoxide and water vapor in the presence of a catalyst selected from the group consisting of alkali metal and alkaline earth metal carbonates, bicarbonates and formates at a temperature of from about 250° C. to about 450° C. and at a pressure of from about 2000 psig to about 5000 psig and contemplates the improvement wherein off-gases from the reactor and hydrocarbon fuel such as oil are burned at a pressure above the reactor pressure with oxygen to provide a carbon monoxide-water vapor gas having a temperature of from about 1100° C. to about 1600° C. and introducing said gas under the surface of the oil slurry in the reactor to provide heat, carbon monoxide, water vapor to said reactor.

The process to which the present invention is directed is suitable for the conversion to oil of solid cellulosic materials including, without limitation, wood, cardboard, urban refuse, sewage sludge, agricultural wastes (e.g., corn cobs and bovine manure) and the like. The invention is also applicable to the processing of lignites. For convience of presentation the invention will be described with respect to the processing of biomass solids.

The biomass solids are comminuted in order to facilitate the formation of a slurry. Generally, the material is communited to provide −10 mesh particles (U.S. mesh size) and desirably −50 mesh particles. If refuse is processed, the refuse may be subjected to conventional pretreatment to remove glass, metal bits and the like.

The biomass solids and oil are then mixed to form a solids-oil slurry. The biomass solids and the oil, (which is principally used as a carrier for the biomass solids), are mixed in proportions that provide a flowable slurry under process conditions. The proportions will depend, inter alia, on particle size and oil viscosity. Generally, the slurry will contain from about 30% to about 50% by weight of solids. Recycle hydrogenated oil which is still at an elevated temperature is advantageously used to form the slurry since the amount of energy required to raise the slurry feed to the reactor temperature will be reduced.

The catalysts used are known to the art and are alkali metal or alkaline earth metal carbonates, bicarbonates or formates. Alkali metal catalysts are preferred and sodium and potassium are preferred alkali metals. Generally at least about 0.2% by weight of catalyst per dry weight of biomass solids is maintained in the reactor.

As indicated above, the reaction is generally conducted at a temperature of from about 250° C. to about 450° C. and at a pressure of from about 2000 psig to about 5000 psig. The reaction is carried out in the presence of carbon monoxide and water vapor and in the absence of air. Under the specified operating conditions some hydrogen will also be present. Residence time in the reactor will obviously vary depending upon the operating conditions chosen but generally will not exceed about 2 hours. Often the residence time will be from about ½ hours to 1 hour. The appropriate residence time readily may be determined for any set of operating parameters and feed stock.

The oil removed from the reactor (i.e., reactor bottoms.) will contain water, spent catalyst and may contain uncoverted biomass solids. Generally, the reactor is run to provide not more than about 5% uncoverted biomass solids in the bottoms stream from the reactor.

The reactor bottoms are processed, as for example by vaporization, to remove desirable light oils. Such processing can be selected to provide a residual slurry containing spent catalyst and unreacted biomass solids in a heavy oil. Since the reactor bottoms are at an elevated temperature and are under pressure, the stream lends itself to flash distillation to separate the light oils and water from the residual heavy oil slurry. After the light oils and water are flashed off, they may be condensed to provide a mixture which readily separates into a water phase and an oil phase.

The light oils obtained from the reactor bottoms may, in themselves, be regarded as the product of the conversion process. Often, however, those oils are hydrogenated in order to upgrade their quality. Hydrogenation can be accomplished by conventional prior art means such as, for example, in the presence of a nickel-molybdenum containing catalyst. Following hydrogenation, the oil may be fractionated.

Recycle oil for the formation of the initial slurry is desirably obtained as one stream produced by the fractionation of the hydrogenated light oils. The recycle stream should, of course, have a boiling point above the reaction temperature at the reaction pressure.

In order to provide carbon monoxide and water vapor for the solids-to-oil conversion in accordance with this invention, the off-gas from the reactor (which contains light hydrocarbons, carbon dioxide, carbon monoxide, water vapor and some hydrogen) is combined with oxygen and with hydrocarbon fuel such as oil, and the mixture is subjected to partial combustion in a partial oxidation reactor. The combustion provides carbon monoxide, water vapor, hydrogen and carbon dioxide. The combustion is conducted so as to provide a gas stream that has a temperature of from about 1000° C. to about 1500° C. and is conducted at a pressure above the pressure in the solids conversion reactor, so that the pressure in the partial reactor will cause the combustion gases to flow into the reactor. The gas stream is introduced into the lower part of the reactor substantially below the liquid level in the reactor. Desirably, the fuel supplied to the partial oxidation reactor, in whole or part, is the heavy oil fraction from the reactor from which the light oils have been removed but which contains spent catalyst and unreacted biomass solids, if any. In such case, the partial oxidation gases will contain carbon monoxide, water vapor, hydrogen, carbon dioxide and regenerated catalyst.

The gas stream provides heat to maintain reaction temperature, provides carbon monoxide and water vapor for the reaction, and may provide regenerated catalyst for the reaction. It also agitates the slurry in the reactor. If hydrogen for the light oil hydrogenation is generated in a hydrogen unit by a shift reaction between water vapor and carbon monoxide, a portion of the carbon dioxide off-gas from the hydrogen unit is also desirably conducted to the partial oxidation reactor and reduced to carbon monoxide.

A portion of the gas generated in the partial oxidation reactor is removed and may be employed for the production of hydrogen by the carbon monoxide shift reaction after removal of ash. Even if a shift reaction is not employed, a portion of the gas from the partial reactor is removed from the process in order to avoid an unwanted build-up of ash in the process.

The various aspects of the present invention will be better understood by reference to the attached drawing which is a schematic flow sheet of a preferred embodiment of this invention.

In the accompanying drawing, dried and sized (e.g., −50 mesh) biomass feed 1 is stored in a surge bin 2. The make-up catalyst, sodium carbonate, is added to the biomass feed prior to its drying. Catalyst is added in sufficient quantities to maintain about 6% by weight catalyst, based on dry weight of biomass solids, in the reactor. The feed is continuously withdrawn from the surge bin by a weighing conveyor 3 and discharged into a blender 4. Hydrotreated recycle oil from line 5, at a temperature in the range from 200° C. to 430° C. is metered into the blender to make a biomass-oil slurry containing from about 20 to about 50% by weight of solids. After mixing, the temperature is in about the 150° C. to 320° C. range. Hot biomass-oil slurry withdrawn via line 6 is pumped into reactor 10 through a feed slurry circulation pump 7 and a high pressure feed pump 8. High pressure pumps such as positive displacement pumps are well known in the art. The feed may be introduced into the reactor without preheating or may be preheated in a preheater 9 before entering the reactor, depending on the temperature of the slurry.

The biomass reactor is a tubular type high pressure vessel operating at a pressure in the range from 2000 to 5000 psig. A hot synthesis gas at a temperature of about 1430° C. and containing predominately carbon monoxide, water vapor and hydrogen, which is produced in a refractory lined partial oxidation reactor 14, is injected into the bottom of biomass reactor through a dip-leg 15. Sensible heat of the synthesis gas as well as heat of condensation of water vapor and heat of reaction of carbon monoxide to carbon dioxide in the reactor provides heat to increase the reactor temperature to a desired level, perferrably about 400° C.

The partial oxidation reactor feed from line 11, a mixture of vacuum bottoms (containing heavy oil, unreacted solids and spent catalyst) from line 63, recycled reactor off-gas (containing light hydrocarbons, carbon dioxide, carbon monoxide and hydrogen) from line 59 and a portion of carbon dioxide in line 60 recovered from a hydrogen unit 65, is reacted with oxygen from line 12 at a pressure some what higher than the biomass reactor operating pressure and at a temperature of about 2600° F. temperature. The spend alkaline catalyst originally contained in the vacuum bottoms from line 63 is regenerated in reactor 14 and is recycled to the biomass reactor with the synthesis gas. A portion of the synthesis gas may be diverted through line 64 to the hydrogen unit 65 for manufacturer of hydrogen, which will be described later. In the embodiment shown, and in the preferred embodiment of the invention, partial oxidation reactor is located on top of high pressure reactor 10. This provides a number of advantages including ease of handling of very hot gas in line 15 which passes downward through the liquid slurry in reactor 10. The partial oxidation reactor, however, may be located adjacent the reactor, if desired.

Reactor bottoms from line 16 is reduced in pressure through a pressure reducing valve 17 and flashes into the bottom section of the light ends stripper 18 below trap-out tray 19 operated at near atmospheric pressure. Flashed vapors from the tower bottom enter the stripper column through the trap-out tray. Oil is condensed from the ascending vapor by reflux and collected in the trap-out tray 19 from which the oil is withdrawn by pump 28. Vapors leaving the stripper from line 20 are cooled in cooler 21 and sent to decanter 22. The water-insoluble organic phase is refluxed through line 24 to the stripper by reflux pump 24*a*. The aqueous phase in line 25 is sent to the waste water treatment unit by transfer pump 26 for separation of pollutants and dissolved organics. Operation of the stripper provides a temperature at the top of the column above the boiling point of water (e.g., about 150° C.). The oil-slurry at the bottom of the column may have a temperature of about 300° C.

Crude product oil slurry withdrawn through line 23 from the bottom of light ends stripper 18, which is substantially free of water, is pumped by transfer pump 30, mixed with a portion of recycled vacuum bottoms from line 31, heated in vacuum still heater 32 and then introduced into a vacuum still 33 below a trapout chimney tray 34. Flashed vapor from the bottom of vacuum still enters a packed section 35 through the chimney tray. The vapor contacts cold reflux 36 introduced at the top of the packed section. Most of the vapor is condensed in the packed section and is trapped on tray 34 and pumped out of the vacuum still by circulation pump 37. A portion of the vacuum still distillate is cooled in cooler 38 and introduced as reflux to the packed section of column 33 through line 36. Non-condensible gases are evacuated from the top of the vacuum still through line 39 by a vacuum system 40 to maintain the operating pressure of the vacuum still at below about 2 psia.

The vacuum still distillate passing through line 41 may be combined with the light ends stripper trap-out oil in line 42 and sent to oil filter 43 to remove any entrained solid particles. The filtered oil is then pumped by high pressure pump 44 and fed to a catalytic hydrogenation unit 45. The oil may be hydrotreated in a fixed bed catalytic reactor operated at a pressure in the range from about 1,000 to about 2,500 psig and temperatures in the range from about 340° C. to about 430° C., and over a conventional hydrotreating catalyst, such as a nickel-containing catalyst. The hydrogenation process is conventional.

Fresh make-up hydrogen in lines 46 produced from unit 65 is fed continuously to hydrotreater 45 while a purge is taken from the hydrotreater effluent flash gas through line 47 to control the purity of hydrogen. The purge gas, which will contain lighter hydrocarbons, is used as plant fuel gas after purification, if necessary, to remove any pollutant which may exist. The hydrotreated oil in line 48 is fed to a conventional fractionation unit 49 where the oil is fractionated, inter alia, into a lighter oil which is removed through line 50 as product and a heavier oil which is recycled to the biomass-oil blender through line 5.

The vacuum still bottoms slurry, which contains unreacted biomass solids, spent alkaline catalyst and heavy product oil, is withdrawn through line 51 by pump 52. A portion of the vacuum bottoms is recycled through line 31 to mix with the vacuum still feed in line 30 before the streams pass through heater 32. The remainder is pumped by high pressure pump 53 to partial oxidation ractor 14 as a feedstock for manufacturing synthesis gas.

The biomass reactor off-gas is passed through line 54 to heat exchanger 55 to cool the gas and condense most of the condensible organic materials and water. The condensate is separated from the gases in separator 56 and is fed to the light ends stripper through line 57 and pressure reducing valve 58 for separation of water and dissolved gases.

The non-condensible off-gas from reactor 10 is mixed with carbon dioxide from line 60. The carbon dioxide is recovered from the carbon dioxide removal unit in the hydrogen unit. A portion of the carbon dioxide from the hydrogen unit can be vented from the system (not shown). The gases are compressed by compressor 61, heated in heater 62, and then mixed with the vacuum still bottoms from line 63 to form the feed for the partial oxidation reactor through line 11.

Hydrogen required for the hydrotreating of product oil may be manufactured from a portion of the synthesis gas produced in the partial oxidation reactor 14. That portion of the synthesis gas is passed through line 64 to hydrogen unit 65 which is operated at a pressure in the range from 1,500 to 3,000 psig. Although the operating pressure is higher than the conventional hydrogen plant, the process used to convert the synthesis gas to pure hydrogen basically follows the conventional steps including: (1) quenching and scrubbing the synthesis gas with water to remove the unreacted carbon and ash from the gas and saturate the gas with water vapor, (2) reacting CO with water over catalysts to form $H_2$ and $CO_2$, and (3) removal of $Co_2$ from the crude hydrogen. At least a portion of $CO_2$ removed by the way of line 66 may be compressed by compressor 67 and recycled to partial oxidation reactor 14 as described earlier. The product hydrogen is sent to the catalytic hydrogenation unit 45 through line 46.

By direct introduction of hot synthesis gas into the reactor from the converter, reliance on a slurry preheater, a unit which tends to be trouble prone, is either reduced or eliminated. In addition, the need for mechanical agitation in the reactor is eliminated. This invention accomplishes these benefits while, at the same time, regenerating spent catalyst, minimizing difficulty in processing residual unreacted solids and making good use of the sensible heat of various process streams.

Other aspects of the invention, provide still other advantages. For example, by hydrogenating the oil prior to recycle, the oil is stabilized and the tendency to polymerize is markedly reduced. Production of hydrogen on site by a shift process also provides $CO_2$ which readily can be converted to CO, which is required for the conversion process. The use of a separate light end stripper provides a facile means to remove water from the system. The water, which is taken overhead as vapor together with light oil vapors, readily can be decanted from the condensed light oil. The light oil stripper requires no energy input beyond that which is already in the feed stream.

Other advantages of the present invention will be obvious to those skilled in the art upon reference to the above detailed description. Since modifications of the described invention will be apparent to those skilled in the art, it is intended that this invention be limited only by the scope of the appended claims.

I claim:

1. In a process for the conversion of solid materials selected from the group consisting of cellulosic biomass materials and lignite to oil wherein a solids-oil slurry is contacted in a reactor with carbon monoxide and water vapor in the presence of a catalyst selected from the group consisting of alkali metal and alkaline earth metal carbonates, bicarbonates and formates at a temperature of from about 250° C. to about 450° C. and at a pressure of from 2000 psig to about 5000 psig the improvement wherein off-gases from the reactor and hydrocarbon fuel are burned with oxygen at a pressure above the reactor pressure to provide a carbon monoxide-water vapor gas having a temperature of from about 1100° C. to about 1600° C. and introducing said carbon monoxide-water vapor gas under the surface of the oil slurry in the reactor to provide heat, carbon monoxide, and water vapor to said reactor.

2. The process of claim 1 wherein said hydrocarbon fuel burned with oxygen is, at least in part, a heavy fraction of reactor product oil which contains spent catalyst.

3. The process of claim 1 wherein said hydrocarbon fuel burned with oxygen is a heavy fraction of reactor product oil which contains spent catalyst and unreacted solids.

4. The process of claim 1 wherein the off-gases from the reactor, hydrocarbon fuel and oxygen are burned in a partial oxidation reactor which is located on top of the conversion reactor.

5. The process of claim 1 wherein the off-gases from the reactor, hydrocarbon fuel and oxygen are burned in a partial oxidation reactor which is located on top of the conversion reactor and flow into the conversion reactor through a conduit that passes downward through the solids-oil slurry in the conversion reactor.

6. The process of claim 1 wherein oil is removed from the conversion reactor, fractionated to remove water and desirable light oils and a slurry of spent catalyst in heavy oil is recycled and burned with off-gases from the reactor and oxygen.

7. The process of claim 1 wherein the solids-oil slurry is formed with a portion of product oil which has been hydrogenated.

8. The process of claim 1 wherein oil is removed from the conversion reactor and fractionated to provide water, desirable light oils and a heavy oil containing spent catalyst; said light oils are hydrogenated to provide a product oil and a recycle oil for the formation of the solids-oil feed slurry; at least a portion of said heavy oil containing spent catalyst is recycled to burn with said oxygen and said conversion reactor off-gases; a portion of said carbon monoxide-water vapor gas is subjected to a shift reaction to provide hydrogen for the hydrogenation of said light oils; and a portion of the carbon dioxide by product of said shift reaction is compressed and added to said reactor off-gas, oil oxygen combustion.

9. The process of claim 1 wherein the solid material is a cellulosic biomass material.

10. The process of claim 7 wherein the cellulosic biomass material is wood.

* * * * *